US005196827A

United States Patent [19]

Allen et al.

[11] Patent Number: 5,196,827

[45] Date of Patent: Mar. 23, 1993

[54] ALARM APPARATUS FOR HANDGUN SECURITY

[76] Inventors: William J. Allen, 7711 Hillside Dr., La Jolla, Calif. 92037; Leon A. Chavis, P.O. Box 8788, La Jolla, Calif. 92038

[21] Appl. No.: 698,788

[22] Filed: May 13, 1991

[51] Int. Cl.[5] ..... G08B 13/14

[52] U.S. Cl. ..... 340/568; 340/666

[58] Field of Search ..... 340/568, 540, 666, 665, 340/510, 595, 599

[56] References Cited

U.S. PATENT DOCUMENTS

| | | | |
|---|---|---|---|
| 3,604,958 | 9/1971 | Palini | 340/568 |
| 3,685,037 | 8/1972 | Bennett et al. | 340/666 |
| 3,750,158 | 7/1973 | Anastassakis | 340/666 |
| 4,155,608 | 5/1979 | Orlewicz | 312/204 |
| 4,267,553 | 5/1981 | Vogelsanger | 340/666 |
| 4,274,088 | 6/1981 | Pierson et al. | 340/568 |
| 4,274,282 | 6/1981 | Budraitis | 340/665 |
| 4,303,908 | 12/1981 | Enemark | 340/384 E |
| 4,378,476 | 3/1983 | Nicholas | 200/85 R |
| 4,716,401 | 12/1987 | Wohlford | 340/666 |
| 4,761,005 | 8/1988 | French | 73/862.59 |
| 4,768,021 | 8/1988 | Ferraro | 340/568 |
| 4,768,375 | 9/1988 | Eckardt | 340/442 |
| 4,788,838 | 12/1988 | Cislo | 70/63 |
| 4,890,466 | 1/1990 | Cislo | 70/63 |

FOREIGN PATENT DOCUMENTS

| | | | |
|---|---|---|---|
| 2371025 | 11/1976 | France | 340/568 |

OTHER PUBLICATIONS

*FSR Technical Specifications*, "Force and Position Sensing Resistors: An Emerging Technology", Interlink Electronics, (Stuart Yaniger and James P. Rivers), Aug. 15, 1989.

*Primary Examiner*—Jin F. Ng
*Assistant Examiner*—Christine K. Oda
*Attorney, Agent, or Firm*—Brown, Martin, Haller & McClain

[57] ABSTRACT

An alarm apparatus for detecting the removal of a handgun from a plate where the handgun is kept for quick accessibility. Embedded sensors detect the force exerted by the handgun on the plate. A handgun is placed on the plate and upper and lower threshold controls are adjusted to create a window encompassing the force exerted by the handgun. An alarm sounds if the force on the plate exceeds the window.

13 Claims, 2 Drawing Sheets

ALARM APPARATUS FOR HANDGUN SECURITY

BACKGROUND OF THE INVENTION

1. Field of the Invention

My invention relates to security devices and more specifically to a security device for preventing the undetected removal of a handgun.

2. Description of the Related Art

Handguns are typically stored in locked cabinets or cases for safety purposes. However, collectors and dealers have a need to display their handguns in an appealing manner, such as on a stand. This presents a dilemma for collectors and dealers who wish to display their handguns at exhibitions or trade shows in a less restrictive manner than employed at home or in a store where additional security is needed: They are typically restricted to either using a locked enclosure or displaying the handgun relatively unsecured. The former method is inconvenient and burdensome. The latter method is convenient but unsafe. A device that provides adequate security at the price of excessive inconvenience discourages people from using it.

Alternatively, quick access is required where a handgun is kept for protective purposes. If a locked case is used to store the handgun, time may be lost in unlocking the case and removing the handgun. In all situations where handguns are stored, it is desirable to provide an alarm to indicate that the gun has been moved by an unauthorized person or a child.

The problem of balancing handgun security with handgun accessibility has been addressed by others in the past. U.S. Pat. No. 4,155,608 issued to Orlewicz discloses a wallmountable gun cabinet having a hinged door, the face of which is disguised as a decorative wall article. A lockable inner door provides some additional measure of security. U.S. Pat. No. 4,768,021 issued to Ferraro discloses a case or safe with an electronic lock having a touch pad on which a code must be entered to gain access to the gun. An alarm sounds if the safe is removed from the surface on which it is mounted. U.S. Pat. No. 4,788,838 issued to Cislo discloses a lockbox for handguns that is lockably attached to a bedframe. Access is gained by entering a code with a touchpad provided on the box. None of these disclosures completely resolve the problems of the inconvenient handgun access and insecure open handgun display.

Alarm systems that have solved the accessibility problem were developed by others for use in museums. U.S. Pat. No. 4,274,088 issued to Pierson discloses a portable alarm system having spring-loaded plungers protruding out from two regions of a flat base member. The bottom plunger is depressed by the stand or table on which the base sits and the top plunger is depressed by the art work placed upon it. The two plungers are connected to switches that activate a tamper alarm if either plunger extends to full protrusion when the alarm is armed. The mechanical plunger switches require that the art object be placed precisely on top of the plunger end to fully depress it. This presents difficulties for irregularly shaped objects, such as handguns. In addition, there is no means for adjusting the resistance of the spring-loaded plungers for objects having different weights. Also, the plunger switches, being accessible, may be defeated by slipping a thin object between the end of the top plunger and the art object or the end of the bottom plunger and the stand or table. It is therefore desirable to prevent access to the sensing means.

The prior art presents no adequate solutions to the problem of securely displaying a handgun, while allowing it to be accessed easily and quickly by authorized persons. In many situations where guns are displayed, high-security enclosures are unnecessary. A security device that allows the owner the option of using it with additional security measures, when circumstances require such, would be highly desirable. These unresolved problems and deficiencies are clearly felt in the art and are solved by my invention in the manner described below.

SUMMARY OF THE INVENTION

My invention provides a handgun security system that allows a handgun to be safely displayed on an open stand or in combination with any suitable enclosure, such as a locked case, without possibility of undetected tampering.

In the preferred embodiment of my invention, an upper base plate is placed on a lower base plate having substantially the same size and shape. One or more force sensors are embedded in the space between the base plates. I prefer force sensors of the thin membrane type that change resistance with applied force, attached to the lower base plate with a suitable adhesive. These sensors require no maintenance and are practically tamperproof.

After placing a handgun on the upper plate, the owner must adjust two variable resistors to define a force threshold window that encompasses the force exerted by the handgun weight. One resistor sets an upper threshold and another resistor sets a lower threshold. The two variable resistors may be adjusted to allow a margin of error to avoid false alarms. A comparator circuit signals when the force on the upper plate falls outside of the established window. The comparator signal activates two audible alarms. The first alarm is deactivated if the gun is replaced. The second alarm, however, latches and remains activated until the circuit is reset by means of a reset switch.

Removing the handgun causes the force exerted on the plate to fall below the lower threshold and activates the alarms. Similarly, a person exerting excessive pressure on the handgun causes the force exerted on the plate to exceed the upper threshold and activates the alarms. An attempt to defeat the device by placing a dummy weight on the upper plate and then removing the handgun will fail because the momentary additional weight will cause the force exerted on the plate to exceed the upper threshold, an important advantage to my invention.

A sensitivity circuit suppresses alarm activation when the handgun weight exceeds the established window for an extremely short period of time, as would occur because of vibration. I prefer using a filter circuit to perform this function. An adjustable control element may be used to produce a sensitivity signal proportional to the desired maximum time period. If the comparator circuit detects a force exceeding the window for a period longer than that represented by the sensitivity control, it activates the alarm. The sensitivity circuit allows the force thresholds to be tightly adjusted to minimize the margin of error without undue false alarms.

The foregoing, together with other features and advantages of my invention, will become more apparent when referring to the following specifications, claims and the accompanying drawings.

DESCRIPTION OF THE PREFERRED EMBODIMENT

Figure 1:
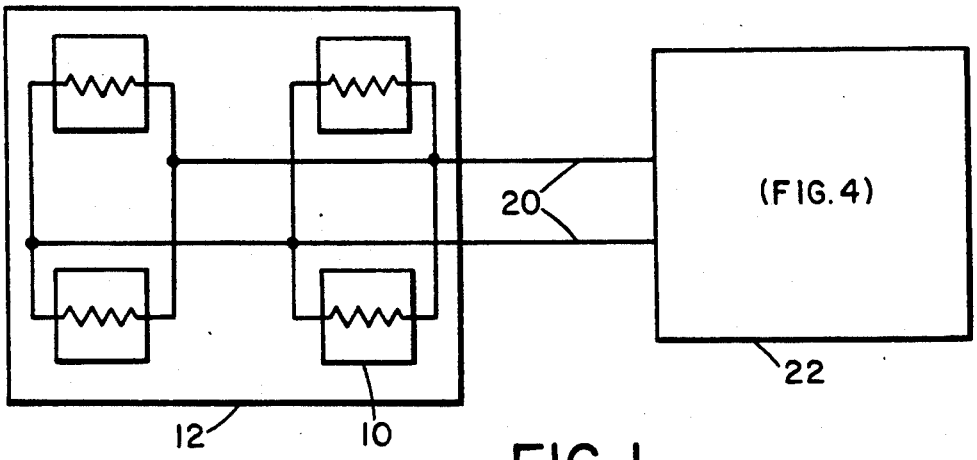
FIG. 1 is a block diagram of the preferred embodiment.
Figure 2:
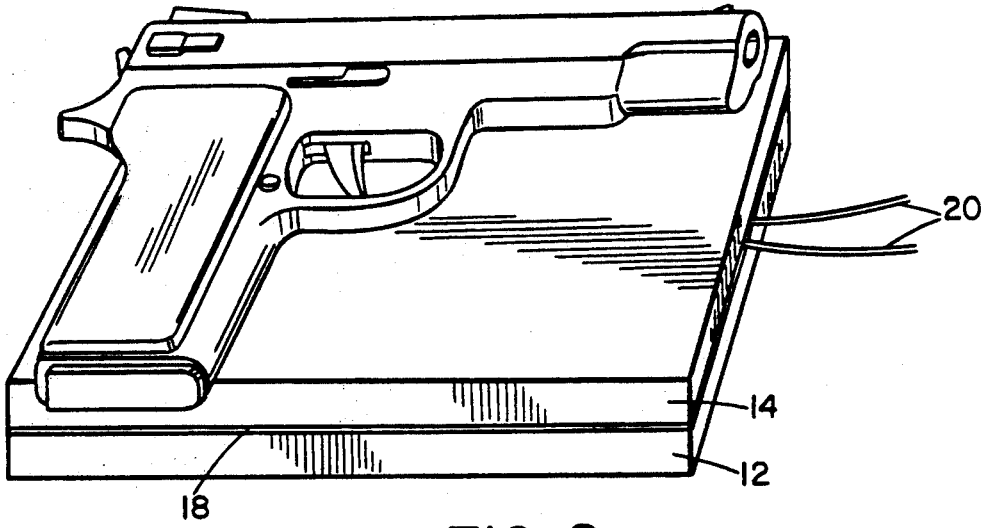
FIG. 2 is a perspective view of the upper and lower plates of the preferred embodiment.

The drawings illustrate a preferred embodiment of the present invention, in which one or more force sensors 10 of the thin-membrane type, are attached to a lower plate 12 with a suitable adhesive. Preferably, the sensor is a force sensing resistor which changes electrical resistance in response to an applied force, for example the FORCE SENSING RESISTOR or FSR sensor device made by Interlink Electronics of Santa Barbara, Calif. A force sensor that changes other electrical properties, such as capacitance in response to applied force, may also be used. Force sensors 10 are arranged in a pattern on lower plate 12 and in symmetry with the shape of lower plate 12 prior to attachment. This provides an even distribution of force among the sensors. For example, one sensor 10 may be placed in each corner of rectangular lower plate 12, as illustrated in FIG. 1.

Figure 3:
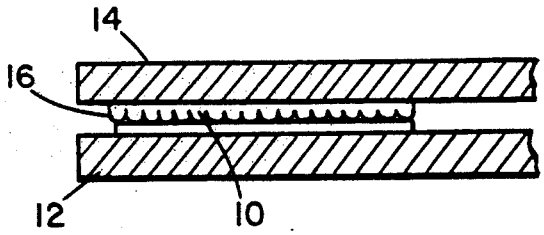
FIG. 3 is a side view of a portion of the upper and lower plates, showing a force sensor and cushioning pad.

Lower plate 12 is made of a solid block of metal, plastic, wood or other suitable rigid material. An upper plate 14, having substantially the same size, shape and material properties as lower plate 12 is placed on lower plate 12. As shown in FIG. 3, the cushioning pads 16 are attached to the areas of the bottom face of upper plate 14 that are in contact with the sensors when upper plate 14 is placed on lower plate 12. Any suitable adhesive may be used to attach cushioning pads 16. Force sensors 10 are thereby embedded in the space 18 between plates 12 and 14 and are cushioned by pads 16 to absorb vibration and compensate for slight imperfections in the surfaces of plates 12 and 14. In the preferred embodiment, force sensors 10 are wired in parallel. Therefore, the two wires 20 connect force sensors 10 to the electronics 22, regardless of the number of force sensors used.

I prefer to physically locate the electronics 22 (FIG. 4) remotely from plates 12 and 14 and their embedded force sensors 10. Electronics 22 comprises the comparator circuit, sensitivity circuit and alarm circuits and must be located in a secure area or else contained within a locked enclosure. Even if an attempt is made to move the entire device, the distance it may be moved is limited by the length of wires 20. If the force threshold window is adjusted for a narrow margin of error and the sensitivity is adjusted to a maximum, any attempt to lift the entire device by grasping lower plate 12 will activate the alarm. An attempt to defeat the alarm by cutting wires 20 will activate the alarm, the apparent resistance of sensors 10 being infinite and therefore lying outside any established window.

In an illustrative embodiment, the electronics 22 may additionally comprise a LED for indicating the condition of the power supply batteries. In another illustrative embodiment, the electronics 22 may be contained within one or more cavities in the upper and lower plates 12 and 14, making the security device self-contained and portable. The cavities may be sealed after adjusting and arming the alarm to deter tampering. A seal made of paper or other suitable material and attached with a permanent adhesive is sufficient to provide an indication of tampering in many situations, such as where a handgun is kept in a home for security purposes. In such a situation, the seal may be quickly broken and the alarm disarmed if removal of the handgun is necessary. In a "permanent" embodiment, lower plate 12 may be securely fastened to the surface on which it rests using a suitable fastening means.

If electronics 22 are located in a secure area remote from plates 12 and 14 and embedded sensors 10 or if access to the reset switch S1 is inhibited by a seal, reset switch S1 may be of any type. Otherwise, reset switch S1 should be a type suitable for security applications, such as a keyoperated switch. The power supply 24 comprises a lithium battery.

Figure 4:
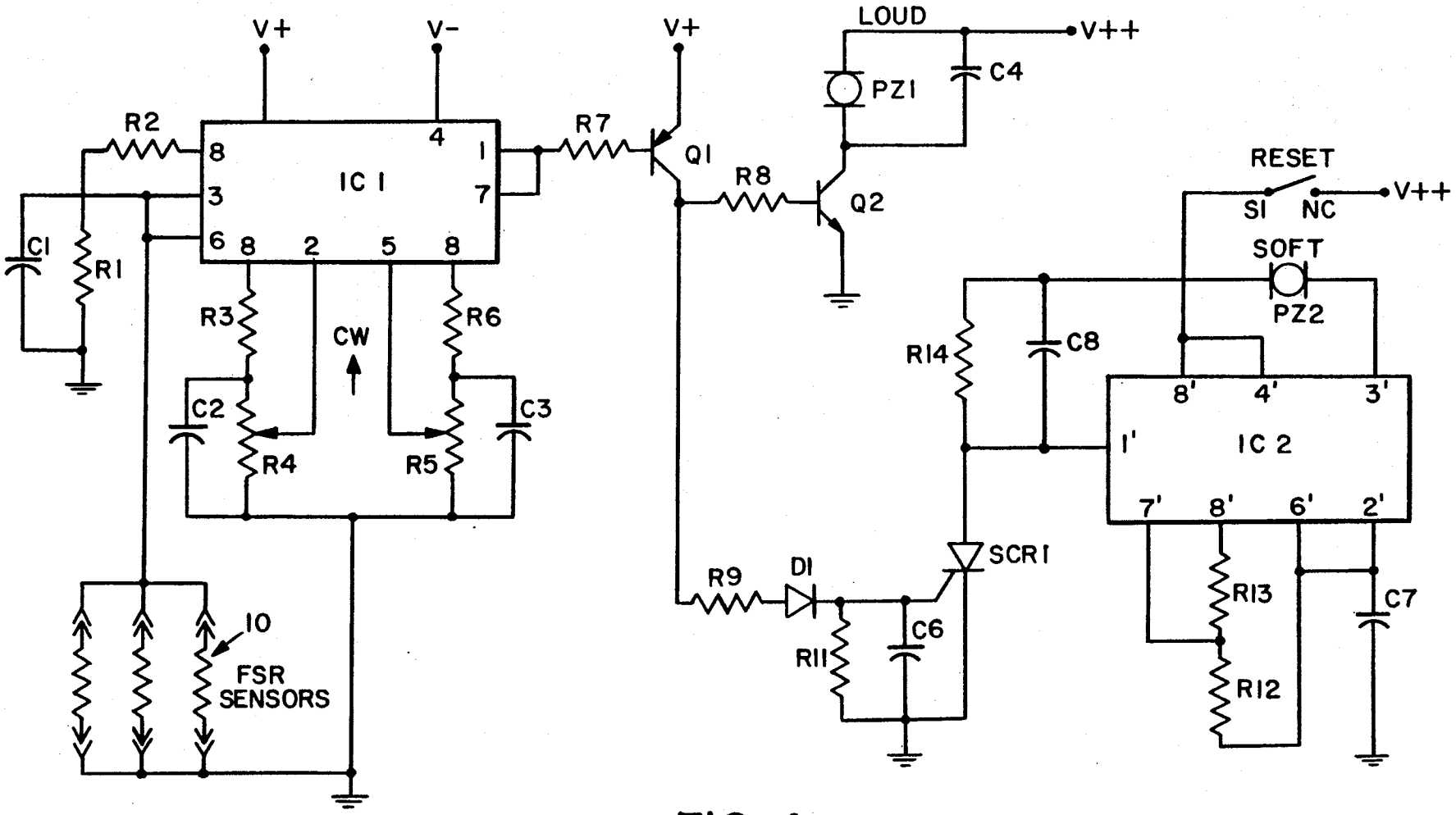
FIG. 4 is a schematic diagram of the preferred embodiment of the electronic circuitry.

FIG. 4 illustrates one embodiment of the electronic circuitry which may be used for activating the alarm signal in response to removal of the handgun. The circuit includes an integrated circuit IC1 having pins 1-8 which is a comparator circuit for providing an output signal if either a high or low force limit is exceeded, and a second integrated circuit IC2 having pins 1'-8' which is an a-stable multi-vibrator for turning on and off two piezoelectric alarms PZ1 and PZ2 for producing loud and soft audible output signals, respectively. The sensor outputs are connected to two inputs of high/low limit comparator IC1. Capacitor C1 and resistors R1, R2 also connected to the sensor outputs act as a sensitivity circuit preventing spurious changes in the sensor outputs from triggering the comparator.

Variable resistor R4 is connected across two pins of comparator IC1 via resistor R3 and capacitor C2 and acts to set the lower threshold, while variable resistor R5 connected via resistor R6 and capacitor C3 across two pins of comparator IC1 acts to set the upper threshold for producing the alarm activating output. The output of the comparator IC1 is connected via resistor R7 to the base of transistor Q1, while the emitter of transistor Q1 is connected through resistor R8 to transistor Q2 which operates piezoelectric alarms PZ1. Transistor Q1 is also connected through resistor R9 and diode D1 to the gate of silicon controlled rectifier SCR1. Resistor R11 and cathode C6 are connected in parallel to the gate-cathode junction of SCR1. The anode of SCR1 is connected through resistor R14 to piezoelectric alarm PZ2, with capacitor C8 connected through resistor R14, and is also connected to an input pin 1 of a-stable multi-vibrator IC2. Piezoelectric alarms PZ2 is connected to pin 3 of multi-vibrator IC2. Reset switch S1 is provided for resetting the multi-vibrator.

Resistors R12 and R13 and capacitor C7 are connected to various pins 2', 6', 7' and 8' of the multi-vibrator IC2 and act together with resistor R14 and capacitor C8 to control the oscillation rate.

The electronic component values are selected such that the force exerted on sensors 10 by upper plate 14 without a handgun or other additional weight causes pin 3 of the comparator IC1 to be more positive than pin 2 of comparator IC1 and pin 6 of comparator IC1 to be more positive than pin 5 of comparator IC1. This in turn causes a base current in the transistor Q1, turning it on, which injects a trigger current into the gate of the silicon controlled rectifier (SCR) SCR1, turning it on. SCR SCR1 remains latched in this state regardless of subsequent removal of the trigger current that would occur if the gun were replaced. The latching of SCR SCR1 causes pin 1 of the astable multivibrator IC2 to go to ground, thereby activating it. The low voltage at pin 1 of astable multivibrator IC2 causes a current through R14; the current aids in keeping SCR SCR1 in a latched state. The current also activates the piezoelectric alarm PZ2. Both astable multivibrator IC2 and piezoelectric alarm PZ2 remain activated until reset switch S1 is opened or the power supply R14 is exhausted. Opening reset switch S1 deactivates astable multivibrator IC2 and breaks the current through SCR SCR1, removing it from the latched state.

When transistor Q1 turns on, a base current is injected into transistor Q2, turning it on, in turn causing a current through the piezoelectric alarm PZ1. The capacitor C4 acts as a bypass capacitor. Piezoelectric alarm PZ1 is deactivated if the handgun is replaced because Q1 will be turned off. The diode D1 prevents any reverse current through the gate of SCR SCR1 from keeping transistor Q2 on (and piezoelectric alarm PZ1 activated) if transistor Q1 turns off because the handgun is replaced. Alarms PZ1 and PZ2 have distinctive sounds because astable multivibrator IC2 causes piezoelectric alarm PZ2 to oscillate at a rate determined by the values of the resistors R12, R13, and R14, and the capacitors C7 and C8; PZ1 does not oscillate. In addition, alarms PZ1 and PZ2 may differ in loudness or other audible characteristics.

To adjust the force threshold window, a handgun is placed on upper plate 14 and reset switch S1 is closed to arm the alarm. The lower threshold is set by adjusting resistor R4 such that a minimum voltage is present at pin 2 of comparator IC1. The upper threshold is set by adjusting resistor R5 such that a maximum voltage is present at pin 5 of comparator IC1. At that point the alarm will be deactivated because the voltage at pins 1 and 7 of comparator IC1 resulting from the force sensor resistance must lie between the thresholds. Then, the upper threshold is lowered by slowly adjusting resistor R5 until the alarm is activated. When that point is reached, the upper threshold can be backed off slightly, to provide a margin of error for the upper threshold. Reset switch S1 is then opened momentarily to deactivate the alarm. Similarly, the lower threshold is raised by slowly adjusting resistor R4 until the alarm is again activated. When that point is reached, resistor R6 can be backed off slightly, to provide a margin of error for the lower threshold. Reset switch S1 is then opened momentarily to deactivate the alarm. The security device is then re-armed by closing switch S1.

A sensitivity circuit comprises a capacitor C1 and a resistor R1. These components act as a low-pass filter, preventing noise spikes and spurious changes in resistance of force sensors 10 from triggering comparator IC1. In other embodiments, this circuit may include a control for varying the filter parameters.

In one specific example of the circuit illustrated in FIG. 4, comparator IC1 was a TLC 393/TLC 372, multi-vibrator IC2 was a TLC 7555, resistors R1, R3, R6 and R7 were all 200 KOhm resistors R4, R5 were 15 turn variable resistors having a maximum value of 200 KOhm, resistors R8, R9, R11 were all 10 KOhm, R12 was 510 KOhm, R13 was 1 MOhm, R14 was 1.5 Kohm and R2 was 100 KOhm. Capacitor C1 was a 10 μF tantalum capacitor, C2, C3, C4 and C8 were all 1.0 μF, Q1 was a 2N3906 PNP transistor, Q2 was a 2N3094 NPN transistor, D1 was a IN914 diode and SCR1 was a 2N5060 SCR.

Obviously, other embodiments and modifications of my invention occur readily to those of ordinary skill in the art in view of these teachings. Therefore, my invention is to be limited only by the following claims, which include all such other embodiments and modifications when viewed in conjunction with the above specification and accompanying drawings.

I claim:

1. An alarm apparatus for sensing the removal of a handgun, comprising:

a lower base plate;

an upper base plate separate from said lower base plate and disposed above and adjacent to the lower base plate, the upper base plate having an upper surface for placement of said handgun on said surface;

at least one alarm means for producing an alarm signal in response to an alarm activation signal;

a symmetrical array of force sensors disposed directly between said lower base plate and said upper base plate and secured to one of said plates, said force sensors each comprising a thin membrane having an electrical property which varies in response tot he force applied to each of said force sensors by said upper and lower base plates;

a cushioning pad located directly between each of said force sensors and one of said plates for cushioning said sensors;

a sensor signal means for providing a voltage comprising a sensor signal proportional to said electrical property of each of said force sensors;

an upper threshold means for providing an upper sensor signal level, the upper threshold means including means for adjusting said upper sensor signal level in response to the force applied by said handgun on said upper base plate;

a lower threshold means for providing a lower sensor signal level, the lower threshold means including means for adjusting the lower sensor signal level in response to the force applied by said handgun on said upper plate;

the upper and lower sensor signal levels together defining a force threshold window encompassing the force exerted by the handgun weight on said upper plate;

a compressor means for detecting said sensor signal and generating an alarm activation signal in response to said sensor signal falling outside the force threshold window bounded by said upper and lower sensor signal levels; and a reset means for resetting the alarm apparatus.

2. The alarm apparatus as in claim 1 wherein said electrical property of said force sensor is resistance.

3. The alarm apparatus as in claim 1 wherein said alarm means comprises an audible alarm means for providing an audible alarm signal.

4. The alarm apparatus as in claim 3 wherein said audible alarm means is a piezoelectric device.

5. The alarm apparatus as in claim 1 further comprising a sensitivity means for establishing the minimum duration of said alarm activation signal necessary to activate said alarm means.

6. The alarm apparatus as in claim 5 wherein said sensitivity means comprises a low pass filter.

7. The alarm apparatus as in claim 1 wherein said lower threshold means comprises a first variable resistor and said upper threshold means comprises a second variable resistor.

8. An alarm apparatus for sensing the removal of a handgun, comprising:

a lower base plate;

an upper base plate disposed above and adjacent to the lower base plate, the upper base plate having an upper surface for placement of said handgun on said surface;

alarm means for producing an alarm signal in response to an alarm activation signal;

at least one force sensor disposed between said lower base plate and said upper base plate, said force sensor having an electrical property which varies in response to the force applied to said force sensor by said upper and lower base plates;

a sensor signal means for providing a voltage comprising a sensor signal proportional to said electrical property of said force sensor;

an upper threshold means for providing an upper sensor signal level;

a lower threshold means for providing a lower sensor-signal level;

comparator means for detecting said sensor signal and generating an alarm activation signal in response to said sensor signal falling outside a signal range bounded by said upper and lower sensor signal levels;

said alarm means comprising a first audible alarm means for providing a first audible alarm signal in response to said alarm activation signal and a second audible alarm means for producing a second audible alarm signal with said first audible alarm signal;

said first and second audible alarm signals differing in at least one audible characteristic;

automatic reset means for deactivating said first audible alarm means in response to detection of said sensor signal within said signal range; and reset means for deactivating said second audible alarm means and resetting the alarm apparatus.

9. The alarm apparatus in claim 8 wherein said first and second audible alarm means are piezoelectric devices.

10. An alarm apparatus for detecting unauthorized removal of a handgun, comprising:

a platform having an upper surface for placement of said handgun on the surface;

the platform comprising an upper base plate on which said handgun is placed, a lower base plate separate from said upper base plate, and a force sensing means located directly between the upper surface of said lower plate and the lower surface of said upper plate for detecting force applied on said sensing means and producing a sensor output signal proportional to the applied force, the force sensing means comprising a symmetrical array of thin membrane force sensing members;

a cushioning pad located between each one of said force sensing members and one of said plates for cushioning said member;

comparator means connected to said sensing means for comparing said sensor output signal to a predetermined signal range and for producing an alarm activation signal if said sensor output signal falls outside said range;

said comparator means including an upper and a lower signal level control means for controlling the upper and lower limits of said predetermined signal range to define a force threshold window encompassing the sensor output signal produced by the weight of the handgun on said platform; and alarm means connected to said comparator means for producing an alarm signal in response to said alarm activation signal.

11. The apparatus as claimed in claim 10, wherein said upper and lower signal level control means comprise variable resistors.

12. A method of detecting unauthorized removal of a handgun, comprising the steps of:

placing the handgun on the upper surface of a sensor platform having upper and lower base plates and force sensing means located between the plates;

connecting the output signal of the force sensing means produced by the weight of the handgun to a comparator circuit;

connecting threshold setting inputs of the comparator circuit to a lower threshold setting circuit and an upper threshold setting circuit;

adjusting the threshold setting circuits to provide a lower threshold level which is a predetermined amount below said output signal and an upper threshold level which is a predetermined amount above said output signal;

the upper and lower threshold levels together defining a force threshold window encompassing the output signal produced by the weight of the handgun;

providing an alarm signal from the comparator circuit to activate an audible alarm if the output of the force sensing means is outside the force threshold window.

13. The method as claimed in claim 12, wherein the step of adjusting the threshold setting comprises adjusting each of the threshold setting circuits in turn with the handgun in place until the alarm is activated, and then adjusting the setting slightly away from the alarm activating position.

* * * * *

UNITED STATES PATENT AND TRADEMARK OFFICE

CERTIFICATE OF CORRECTION

PATENT NO. : 5,196,827

DATED : March 23, 1993

INVENTOR(S) : William J. Allen, et al.

It is certified that error appears in the above-identified patent and that said Letters Patent is hereby corrected as shown below:

Column 6, Claim 1, lines 26 and 27 "tot he"

should be --to the--.

Column 6, claim 1, line 50, "compressor" should be --comparator--

Signed and Sealed this

Seventh Day of December, 1993

*Attest:*

*Attesting Officer*

BRUCE LEHMAN

*Commissioner of Patents and Trademarks*